US006109822A

United States Patent [19]

Campbell et al.

[11] Patent Number: 6,109,822

[45] Date of Patent: Aug. 29, 2000

[54] VALVE ACCESS COVER ASSEMBLY

[76] Inventors: Lucky Campbell, 449 E. Topeka Dr., Phoenix, Ariz. 85024; Rodger Calder, 2611 S. 450 East, Bountiful, Utah 84010

[21] Appl. No.: 09/122,706

[22] Filed: Jul. 27, 1998

[51] Int. Cl.[7] ..... E02D 29/14

[52] U.S. Cl. ..... 404/25; 52/20

[58] Field of Search ..... 404/25, 26; 220/484, 220/235, 236; 52/19, 20; 138/89

[56] References Cited

U.S. PATENT DOCUMENTS

| | | | |
|---|---|---|---|
| 139,938 | 6/1873 | Williams | 404/25 |
| 653,909 | 7/1900 | Greger | 404/25 |
| 680,287 | 8/1901 | Steele | 404/25 |
| 1,384,712 | 7/1921 | Shanley | 404/25 |
| 1,987,502 | 1/1935 | Born et al. | 404/25 |
| 2,163,221 | 6/1939 | Slocum | 404/25 |
| 4,013,374 | 3/1977 | Weiler et al. | 404/25 |
| 4,048,766 | 9/1977 | Dantzer et al. . | |
| 4,203,686 | 5/1980 | Bowman | 404/25 |
| 4,597,692 | 7/1986 | Gruenwald | 404/25 |
| 4,650,365 | 3/1987 | Runnels | 404/25 |
| 4,726,707 | 2/1988 | Newton | 404/25 |
| 4,772,154 | 9/1988 | Caroulle | 404/25 |
| 5,240,346 | 8/1993 | Yin | 404/25 |
| 5,382,113 | 1/1995 | Chilton et al. | 404/25 |
| 5,401,114 | 3/1995 | Guggemos | 404/25 |
| 5,404,676 | 4/1995 | Devlin . | |
| 5,778,934 | 7/1998 | Campbell | 138/89 |
| 5,827,007 | 10/1998 | Barton et al. | 404/25 |
| 5,951,200 | 9/1999 | Barton | 404/25 |

*Primary Examiner*—Eileen D. Lillis
*Assistant Examiner*—Raymond W. Addie
*Attorney, Agent, or Firm*—Harry M. Weiss; Jeffrey Weiss; Harry M. Weiss & Associates, P.C.

[57] ABSTRACT

Lid 12 has affixed thereto an annular resilient flap 26 which cooperates with a flange 21 on a lid support 13 to resist dislodgement of the lid. The flap 26 i worked into position beneath the flange 21 by rotation of the lid about its axis. A container portion 34 of the lid may contain a granular material to add weight to the lid.

1 Claim, 2 Drawing Sheets

VALVE ACCESS COVER ASSEMBLY

TECHNICAL FIELD

This invention has to do with closing the upper end of an access pipe for an underground shut-off valve.

BACKGROUND ART

Municipal utilities usually bury their mains under public rights of way, such as streets, at spaced intervals throughout the system. Normally open shut-off valves are incorporated for the purpose of isolating main breaks so they can be repaired or new connections established.

The shut-off valves are frequently buried several feet beneath the street and access pipes are provided which extend upwardly from the valve to near street level. The access pipe provides a passage for a tool which can be manipulated from street level to actuate the valve.

A cover assembly with a removable lid is usually incorporated in the street pavement to prevent debris from entering the access pipe.

It has been customary to fabricate both the lid and the lid support of the cover assembly from cast iron. These are of low cost and durable. Iron castings, however, are notorious for dimensional variations from one casting to the next. Consequently, it frequently is the case that there is a poor fit between the lid and the lid support.

Nevertheless, cast iron has remained the material of choice because it is strong and capable of withstanding the rigors to which a pavement-mounted assembly is subjected.

It has more recently been recognized that quality cover assembly components can be modeled from light-weight synthetic polymeric material. U.S. Pat. No. 4,048,766, granted Sep. 20, 1977, to P. H. Dantzer et al. for "Closure Lid Assembly for Protective Housings" suggests the components be formed by a structural foam molding process.

The light weight of the lid in the Dantzer et al. assembly requires that special retaining means and a locking system be provided in the design to prevent the lid from being accidentally dislodged.

It is also known to provide sealing flaps on the periphery of a lid to seal the junction between the lid and it's support structure. An example of this technique is illustrated in U.S. Pat. No. 5,404,676, granted Apr. 11, 1995, to M. Devlin for "Watertight Pit Cover".

There continues to be a need for an access cover assembly which can be easily molded from polymeric material and which will perform reliably in service.

DISCLOSURE OF THE INVENTION

The cover assembly of this invention comprises a lid having a rim adapted to rest on a ledge on a lid support. An annular resilient flap projecting outwardly and upwardly from the lid cooperates with an annular flange protruding inwardly from the lid support. The outside diameter of the flap is greater than the inside diameter of the flange so the flap is folded upwardly against the flange when the lid is first installed on the lid support. Rotation of the lid and the flap thereon causes the flap to be worked o a position beneath the flange to resiliently retain the lid on the lid support.

The lid preferably comprises a lid cap and a container affixed beneath the cap. Dense granular material in the container weighs down the lid, further assisting retention of the lid on the lid support. A tie rod extending from the lid cap to an access opening connects with a removable closure for the access opening and ties the container to the lid cap.

BRIEF DESCRIPTION OF THE DRAWINGS

The invention is described in greater detail hereinafter by reference to the accompanying drawings wherein.

BEST MODE FOR CARRYING OUT THE INVENTION

Figure 1:
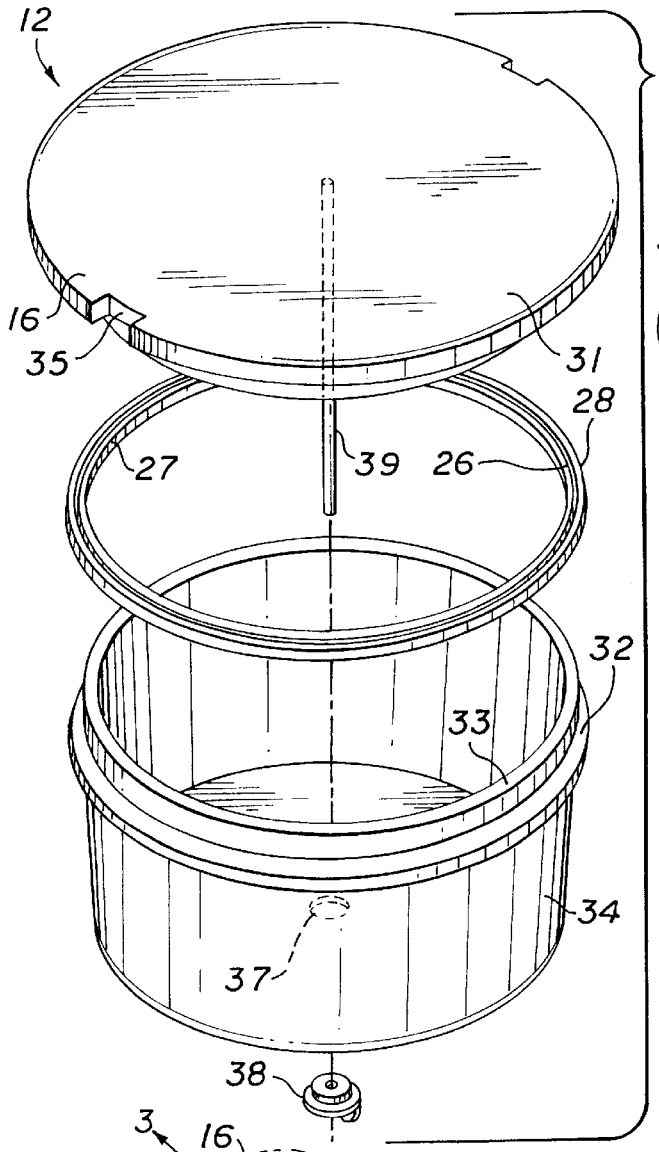
FIG. 1 is an exploded perspective view of the lid portion of the cover assembly of the invention.
Figure 5:
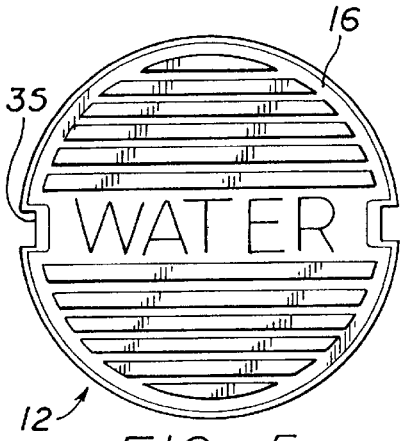
FIG. 5 is a top view of the lid.
Figure 6:
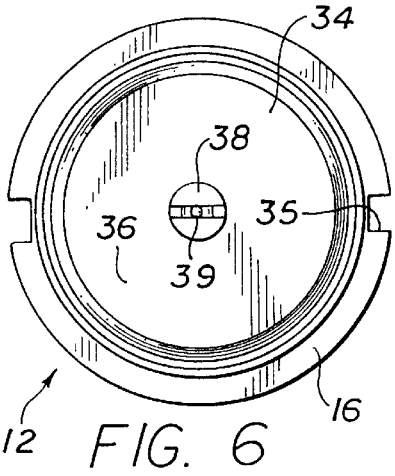
FIG. 6 is a bottom view of the lid.
Figure 2:
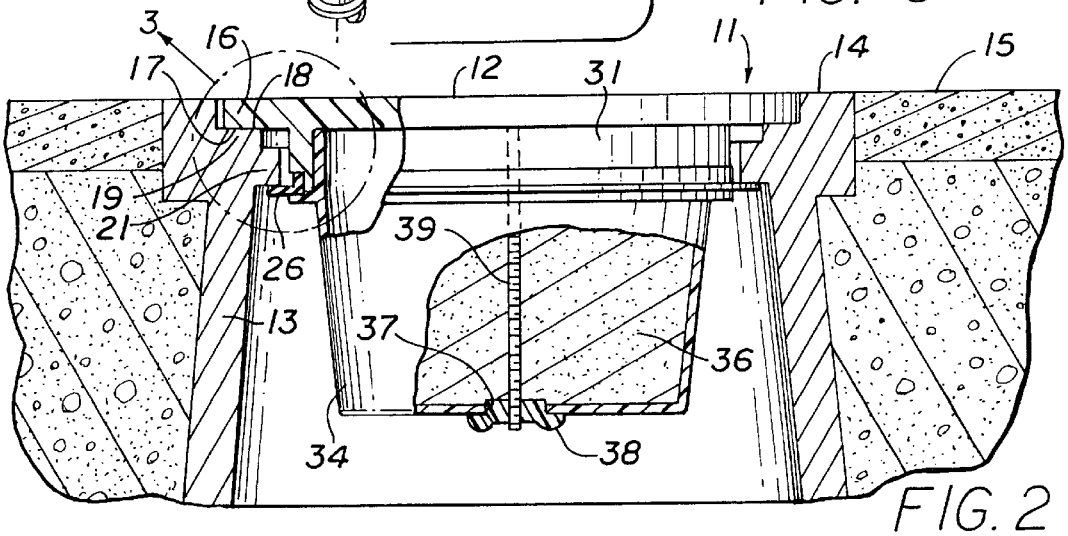
FIG. 2 is a vertical sectional view of the cover assembly of the invention, with the lid partially in section.

Referring to FIG. 2, the cover assembly of this invention is designated generally by reference numeral 11. The cover assembly comprises two components, namely a lid 12 and a lid support 13.

Lid support 13 is adapted to be encased in paving materials with its upper surface 14 flush with the pavement surface 15. The lid support 13 may be made of metal or molded plastic, with virtually all existing installations being in cast iron. Lid 12, on the other hand, is preferably fabricated from plastic material, such as, fiber reinforced, high density polyethylene.

Lid 12 has an annular outer rim 16 having a lower surface 17 adapted to rest on the upper surface 18 of an annular ledge 19 on the lid support 13.

Lid support 13 also has an inwardly projecting annular flange 21 disposed inwardly of and beneath ledge 19. Flange 21 has a smooth, substantially upright cylindrical inner surface 22 and an upper surface 23 and a lower surface 24. (See FIG. 3).

Lid 12 carries a resilient annular flap 26 which is employed to retain the lid in position on the lid support 13. Flap 26 is comprised of a retention ring 27 and a working extension 28. Retention ring 27 of flap 26 is clamped between a land 29 on a depending annular sleeve 30 on cap 31 of the lid and the upper surface of a flange 32 on an upper annular sleeve 33 on a container beneath the lid cap. (See FIG. 3).

Flap 26 is preferably molded in a configuration in which it's working extension 28 extends outwardly and upwardly at an acute angle to the vertical The outermost rim, or edge, of the working extension 28 has a diameter which is greater than the diameter of the inner surface 22 of flange 21 on the lid support 13. This relationship ensures that the working extension 28 of the flap 26 will be in firm contact with and frictionally engaged with surface 22 of flange 21 when the lid 12 is seated into lid support 13.

Figure 3:
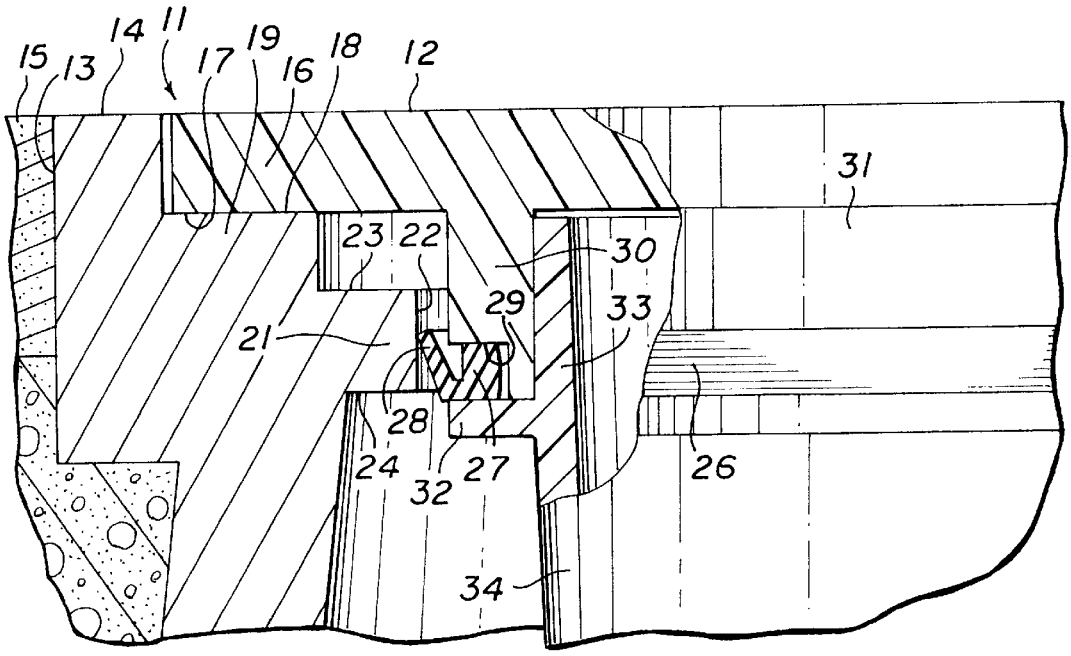
FIG. 3 is an enlarged sectional view of that portion of the cover assembly encompassed in the circle 3 in FIG. 2.
Figure 4:
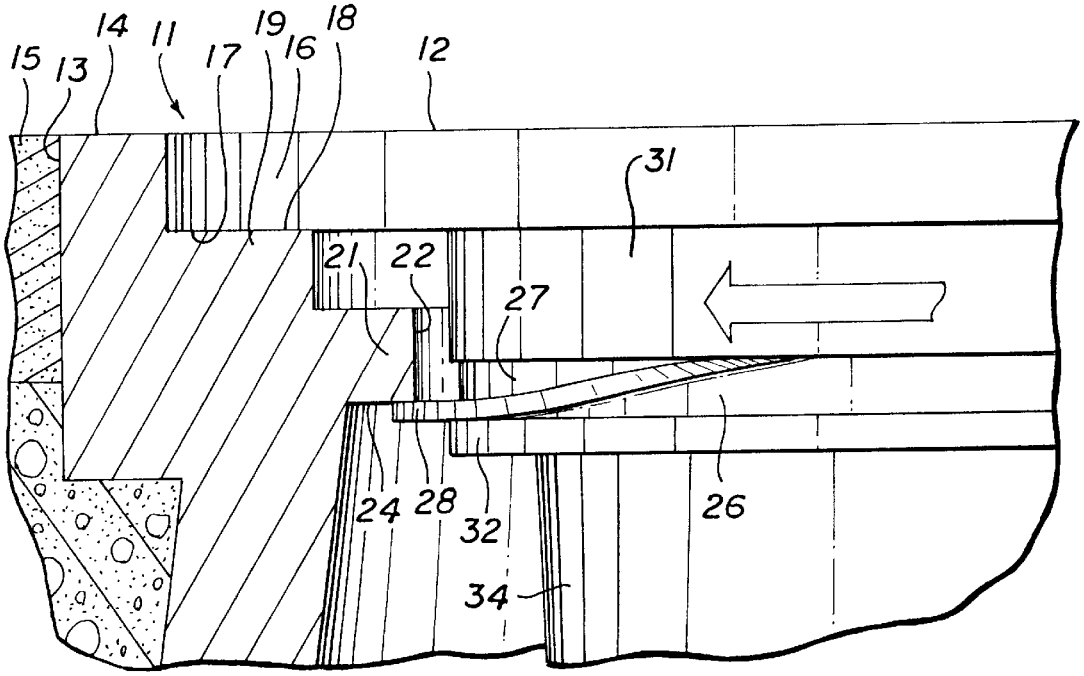
FIG. 4 is a view similar to FIG. 3 illustrating the manner in which a flap on the lid is worked beneath a flange on the lid support.

This frictional engagement is critical to proper functioning of the flap 26 in retaining lid 12 on lid support 13. Once the lid 12 is seated in the lid support 13, as shown in FIG. 3, the lid is rotated about its vertical axis to work the extension 28 of flap 26 to a position beneath flange 21 in lid support 13, as shown in FIG. 4. The working of flap extension 28 is a natural phenomenon which takes place with rotation of lid 12 against the frictional resistance generated between the flap extension 28 and flange surface 22. And less than one complete turn of the lid 12 is required to snap the flap extension 28 beneath flange 21.

To facilitate turning lid 12, the outer rim 16 of the lid may be provided with tool-receiving notches 35.

If additional down force for retention of lid 12 in lid support 13 is desired, the container 34 forming part of the lid may be filled, at lest partially, with a dense granular material, such as sand 36. (FIG. 2).

To facilitate filling container 34, the bottom wall of the container is provided with an access opening 37 having a removable closure 38.

The integrity of the container 34/lid cap 31 combination can be enhanced by providing a threaded tie rod 39 affixed to the lid cap 31 and extending to the vicinity of container access opening 37. With the removable closures 38 provided with a threaded opening for mating with tie rod 39, the closure can act as a nut for forcing the container 34 up against the lid cap 31.

What is claimed is:

1. A cover assembly comprising a lid and a lid support, said lid having an annular rim having a lower surface, said lid support having an annular ledge having an upper surface in contact with the lower surface of the rim of said lid, said lid support further having an annular flange protruding inwardly thereof beneath the annular ledge of said lid support, said annular flange of said lid support having a substantially upright cylindrical inner surface with upper and lower edges, an annular resilient flap secured to said lid for rotation therewith and having an exterior portion extending outwardly and upwardly relative to said substantially upright cylindrical inner surface of said lid support and having a portion of said exterior portion of said annular resilient flap in contact with said substantially upright cylindrical inner surface of said lid support prior to rotation of said lid, said exterior portion of said annular resilient flap is moved only upon rotation of said lid to a position where said portion of said exterior portion of said annular resilient flap is moved out of contact with said substantially upright cylindrical inner surface of said lid support to a position below said lower edge of said annular flange of said lid support, and a container attached to and depending from said lid and a granular material in said container for weighing down the lid.

* * * * *